US008210115B2

(12) United States Patent
Frigstad

(10) Patent No.: US 8,210,115 B2
(45) Date of Patent: Jul. 3, 2012

(54) DRILLING VESSEL DEVICE

(75) Inventor: Harald Frigstad, Kristiansand (NO)

(73) Assignee: Frigstad Engineering Ltd (CY)

( * ) Notice: Subject to any disclaimer, the term of this patent is extended or adjusted under 35 U.S.C. 154(b) by 539 days.

(21) Appl. No.: 12/438,206

(22) PCT Filed: Aug. 20, 2007

(86) PCT No.: PCT/NO2007/000289

§ 371 (c)(1),
(2), (4) Date: Feb. 20, 2009

(87) PCT Pub. No.: WO2008/023988

PCT Pub. Date: Feb. 28, 2008

(65) Prior Publication Data

US 2010/0294189 A1 Nov. 25, 2010

(30) Foreign Application Priority Data

Aug. 21, 2006 (NO) ..... 20063730

(51) Int. Cl.
*B63B 35/44* (2006.01)

(52) U.S. Cl. ..... 114/265

(58) Field of Classification Search ..... 114/264–266
See application file for complete search history.

(56) References Cited

U.S. PATENT DOCUMENTS

| | | | | |
|---|---|---|---|---|
| 4,436,050 | A * | 3/1984 | Liden | 114/265 |
| 6,247,421 | B1 * | 6/2001 | Ludwigson | 114/265 |
| 6,848,382 | B1 | 2/2005 | Bekker | |
| 7,377,225 | B2 * | 5/2008 | Finn et al. | 114/264 |

FOREIGN PATENT DOCUMENTS

GB 2085814 A 5/1982

OTHER PUBLICATIONS

International Search Report dated Dec. 21, 2007, issued in corresponding international application No. PCT/NO2007/000289.

* cited by examiner

*Primary Examiner* — Stephen Avila
(74) *Attorney, Agent, or Firm* — Ostrolenk Faber LLP

(57) ABSTRACT

A drilling vessel device comprising a deck structure including at least a main deck with several generators, and a cellar deck providing a passage for at least a main cable from a generator to a consumption item, where the cellar deck is provided with at least one about the central vertical axis of the drilling vessel encircling cable compartment.

4 Claims, 4 Drawing Sheets

Ib-Ib

Ia-Ia

Ib-Ib

Ic-Ic

DRILLING VESSEL DEVICE

CROSS REFERENCE TO RELATED APPLICATIONS

The present application is a 35 U.S.C. §371 National Phase conversion of PCT/NO2007/000289, filed Aug. 20, 2007, which claims benefit of Norwegian Application No. 20063730, filed Aug. 21, 2006, the disclosure of which is incorporated herein by reference. The PCT International Application was published in the English language.

FIELD OF THE INVENTION

This invention relates to a drilling vessel. More specifically it relates to a drilling vessel with a deck structure comprising at least a main deck with multiple generators, and a cellar deck providing a passage for at least a main cable from a generator to a consumption item. The cellar deck is provided with at least one possibly divided cable compartment surrounding the vertical centre of the drilling vessel.

BACKGROUND ART

The most important functional systems on a drilling vessel must, to satisfy current regulations, have a certain overcapacity such that for example safe positioning by means of for example thrusters can be maintained even if unintended events should occur.

Events of this kind may comprise damage caused by outside events where one or more components are put out of action, or internal damage in the form of breakdown, fire, flooding or the like.

In prior art e.g. propulsion plants are split into groups whereby safe operation can be maintained even if one of the groups should fail. It is also common that components from one group may be activated to serve another group if the need should arise.

It is obvious that for example adequately segregated running of cables on a drilling vessel from generators via distribution boards and to said thrusters, typically via a deck, columns and pontoons, can be challenging. It is a common requirement for a drilling vessel to be capable of continuing operation following a single damage to the vessel.

This means that a fire e.g. in a supporting column must not damage the power supply to more than for example one quarter of the thrusters. When the requirement, as an example, is that thrusters belonging to the same group and placed in different positions in the vessel shall remain intact even if the vessel is damaged, the complexity of running of cables is increased considerably. Important cables should therefore be placed in different areas and spaced well apart, which due to limited space is difficult to achieve.

The object of the invention is to mitigate or reduce at least one of the disadvantages of prior art.

The object according to the invention is achieved by the features stated in the description below and in the following claims.

SUMMARY OF THE INVENTION

A drilling vessel in accordance with the invention comprising a deck structure including at least a main deck with multiple generators, and a cellar deck providing a passage for at least a main cable from a generator and to a consumption item, is characterised in that the cellar deck is provided with at least one cable compartment surrounding the drilling vessel vertical centre.

The cable compartment may extend along the outer wall of the cellar deck and in approximately full deck height. It may also be practical that the cable compartment extends at a distance from the outer wall of the cellar deck.

The generators' power cables extend to respective distribution boards wherefrom main cables are laid to the various thrusters and to other consumption components. By laying the cables via cable compartments in the cellar deck, the main cables from a distribution board may be laid separately from main cables belonging to other distribution boards and thereby be kept apart from other main cables along the complete laying path from its respective distribution board and to for example a column where it may be lead down to its respective thruster via a shaft.

It is often necessary to employ two separate cable compartments to achieve adequate spacing of the various cables. The cable compartment may be provided with bulkheads and intermediate decks which e.g. divides the cable compartment into fire zones.

Advantageously the cable compartments may in a manner known per se be shielded from e.g. fire or mechanical loading.

Use of the device according to the invention provides a substantially improved and well arranged and uncomplicated layout of important power and control cables on a drilling vessel since no main cables from different distribution boards and to important consumption items run in a common compartment.

BRIEF DESCRIPTION OF THE DRAWINGS

In the following an example of a preferred embodiment is described and illustrated in the appended drawings wherein.

DESCRIPTION OF THE PREFERRED EMBODIMENT(S)

Figure 1:
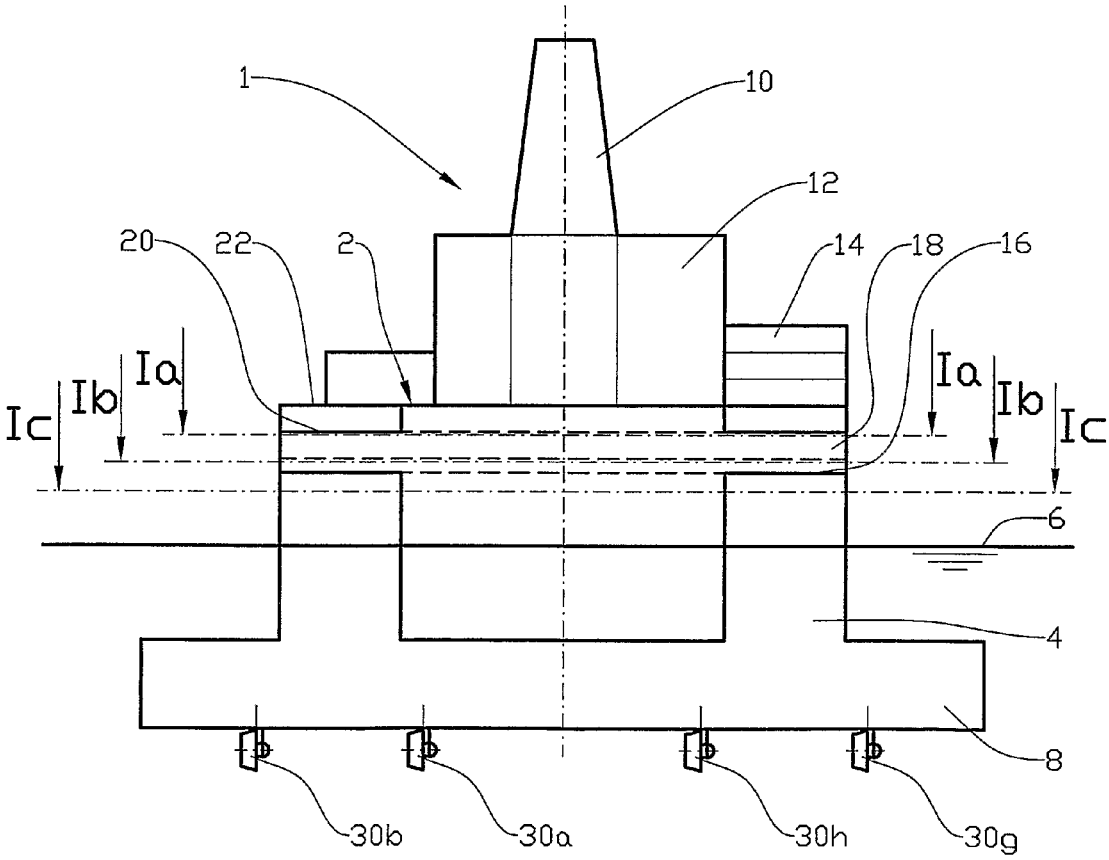
FIG. 1 shows a schematic side elevational view of a drilling vessel provided with a cellar deck.

In the drawings the reference numeral 1 indicates a drilling vessel comprising a deck structure 2 and where pontoons 8 carry the deck structure 2 via columns 4, which extend up through the sea surface 6. The deck structure 2 is provided with a drilling derrick 10, a pipe rack 12 and a living quar-ter 14.

The deck structure 2 comprises a cellar deck 16 positioned above the columns 4 and a main deck 18 positioned above the cellar deck 16. An intermediate deck 20 and a pipe rack deck 22 are provided above the main deck 18.

The cellar deck 16 comprises an outer cable compartment 24 and an inner cable compartment 26 where both surround the vertical centre axis 28 of the drilling vessel 1. The cable compartments 24, 26 are formed such that equipment placed in the cable compartments 24, 26 to the largest possible extent is shielded from events taking place elsewhere on the drilling vessel 1.

The pontoons 8 are on their underside provided with a first to an eighth thruster 30*a*-30*h*. The thrusters 30*a*-30*h*, constituting consumption items, are each driven by an electric motor (not shown) positioned within the pontoons 8 just above their respective thrusters 30*a*-30*h*.

Figure 2:
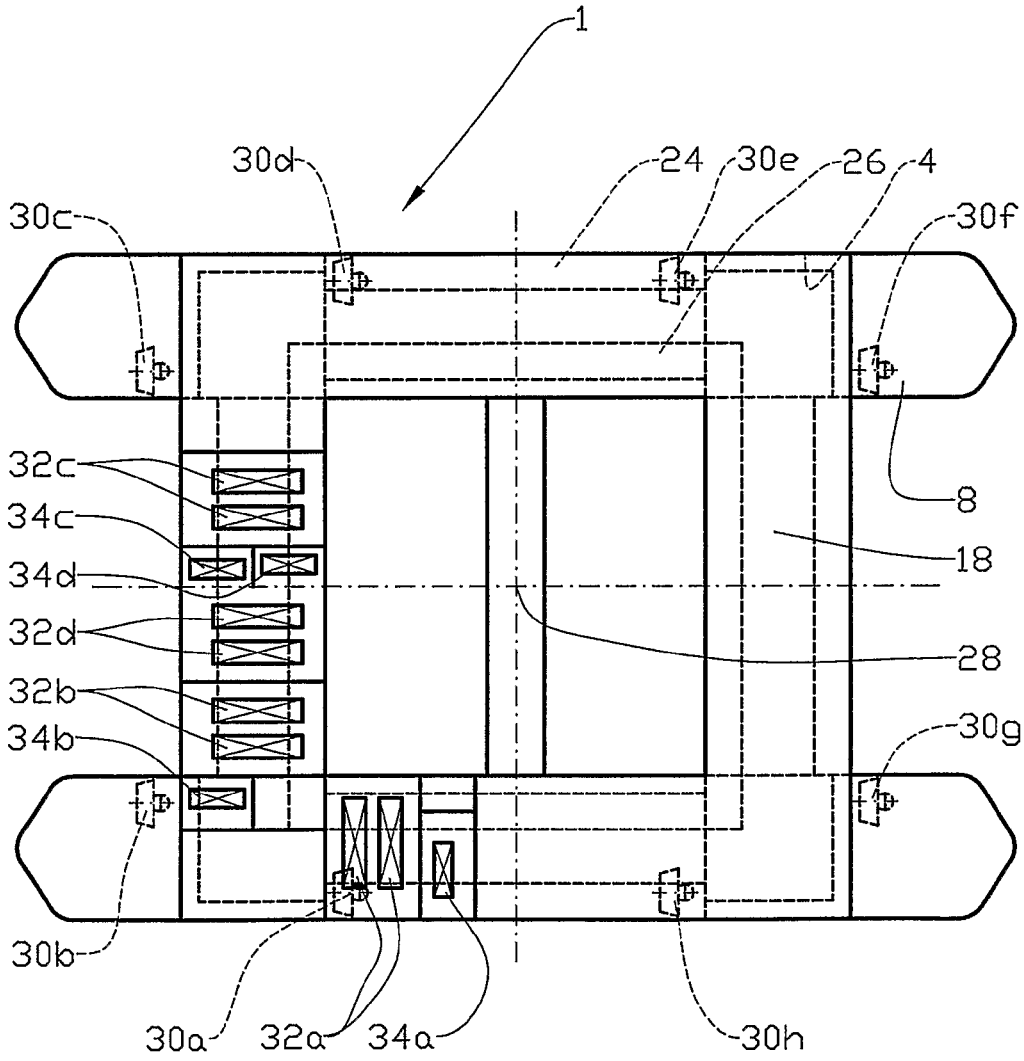
FIG. 2 shows schematically a section Ia-Ia of FIG. 1.

In FIG. 2 the section Ia-Ia shows a plan view of the main deck. In the section Ia-Ia, only energy supply components such as first to fourth generators 32*a*, 32*b*, 32*c* and 32*d* and accompanying first to fourth distribution boards 34*a*, 34*b*, 34*c* and 34*d* are shown.

First to eighth main cables 36*a*-36*h* run as explained below between their respective distribution boards 34*a*-34*d* and to corresponding thrusters 30*a*-30*h*. It is emphasized that none of the main cables belonging to different distribution boards 34*a*-34*d* run in a common room.

To minimise the effect of e.g. a generator breakdown, each of the generators 32*a*-32*d* powers two of the thrusters 30*a*-30*h*, whereof the two relevant thrusters, for example the second thruster 30*b* and the fifth thruster 30*e*, which in the embodied example is powered by the third generator 32*c* via the third distribution board 34*c*, are diagonally positioned relative to each other on the drilling vessel 1.

A first main cable 36*a* runs from distribution board 34*a* via the outer cable compartment 24 to a first thruster 30*a*, and a sixth main cable 36*f* runs via the outer cable compartment 24 to a sixth thruster 30*f*, (see FIG. 3) where also the distribution boards 34*a*-34*d* are indicated even if they are positioned on the main deck 18.

Correspondingly, from the second distribution board 34*b*, the third main cable 36*c* runs via the inner cable compartment 26 to the third thruster 30*c*, and the eighth main cable 36*h* via the inner cable compartment 26 to the eighth thruster 30*h*.

From the third distribution board 34*c*, the second main cable 36*b* runs to the second thruster 30*b*, and the fifth main cable 36*e* to the fifth thruster 30*e*. Both main cables 36*b* and 36*e* run in the outer cable compartment 24, but in opposite directions relative to each other.

From the fourth distribution board 34*d*, the fourth main cable 36*d* runs to the fourth thruster 30*d*, and the seventh main cable 36*g* to the seventh thruster 30*g*. Both main cables 36*d* and 36*g* run in a common direction in the inner cable compartment 26.

Figure 3:
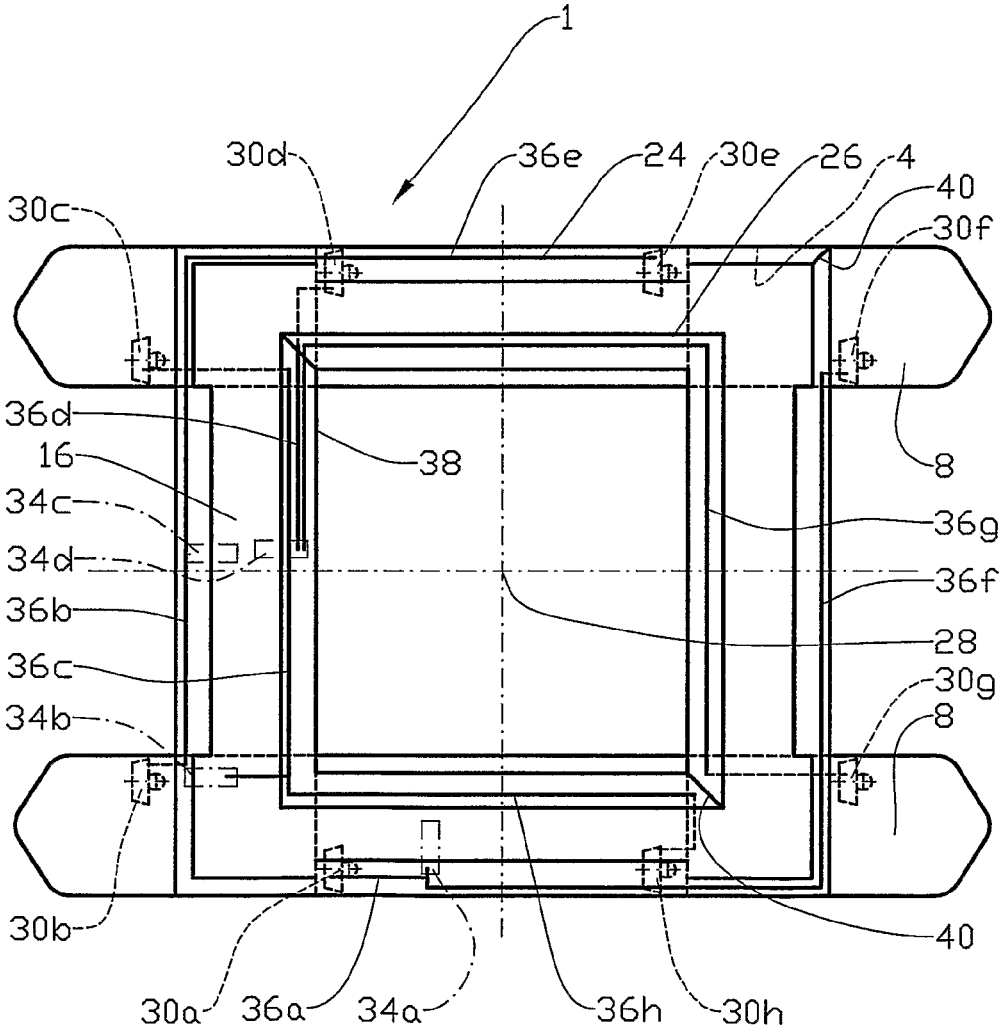
FIG. 3 shows schematically a section Ib-Ib of FIG. 1.

As shown in FIG. 3, the third main cable 36*c*, connected to the second distribution board 34*b*, runs in parallel to the fourth main cable 36*d* and the seventh main cable 36*g*, both being connected to the fourth distribution board 34*d*, in a common portion 38 of the inner cable compartment 26. However, there is arranged an intermediate deck (not shown) in the portion 38 of the inner cable compartment 26 to separate the third main cable 36*c* from the main cables 36*d* and 36*g*.

There is further arranged a number of bulkheads 40 in the cable compartments 24, 26.

Figure 4:
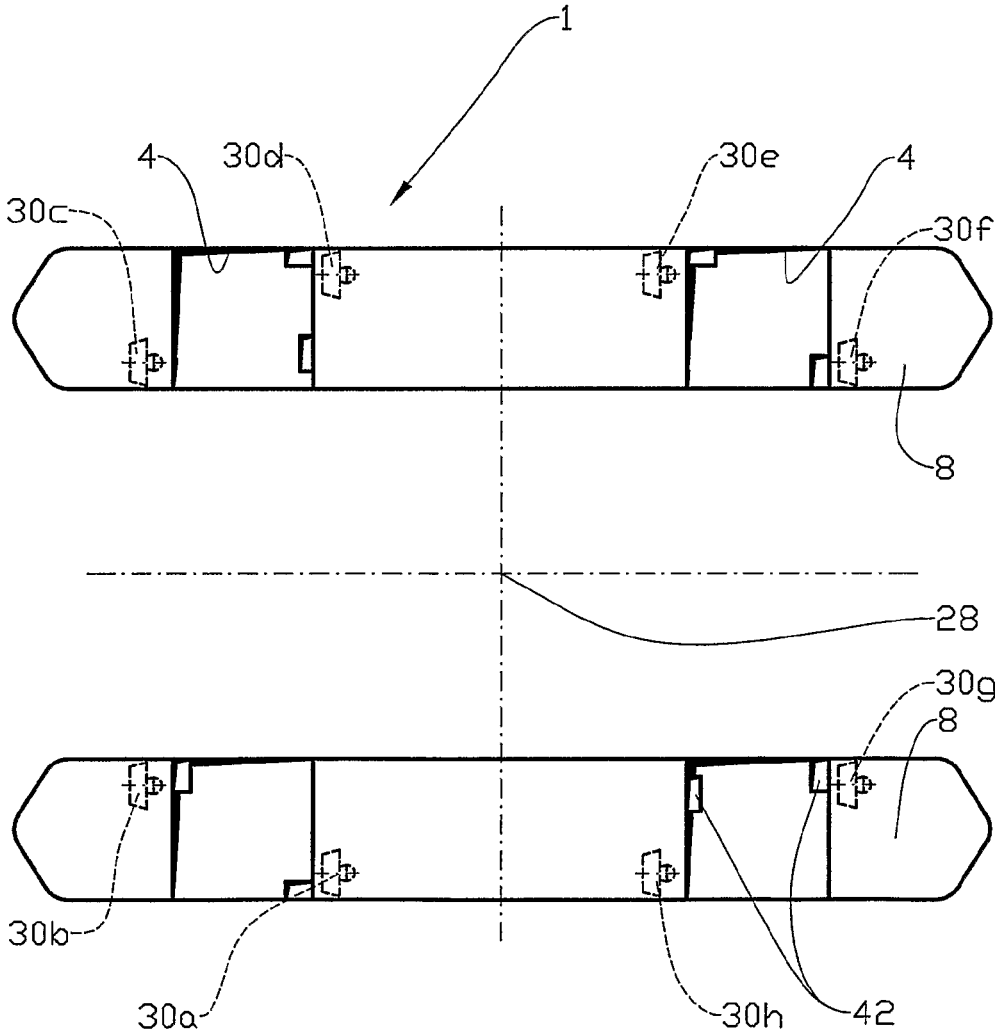
FIG. 4 shows schematically a section Ic-Ic of FIG. 1.

The cable compartments 24, 26 correspond with cable shafts 42 running in the columns 4 and which thereby provide a protected path for the respective main cables 36*a*-36*h* up to the thrusters 30*a*-30*h*. The cable shafts are indicated in FIG. 4.

What is claimed is:

1. A drilling vessel device comprising a deck structure including at least a main deck with several generators, and a cellar deck providing a passage for at least a main cable from a generator to a consumption item, wherein the cellar deck is provided with at least one cable compartment surrounding the central vertical axis of the drilling vessel, wherein an outer cable compartment runs along the outer wall of the cellar deck in approximately full deck height.

2. A drilling vessel device comprising a deck structure including at least a main deck with several generators, and a cellar deck providing a passage for at least a main cable from a generator to a consumption item, wherein the cellar deck is provided with at least one cable compartment surrounding the central vertical axis of the drilling vessel, wherein an inner cable compartment runs at a distance from the outer wall of the cellar deck in approximately full deck height.

3. A device according to claim 1 or 2, wherein the cable compartment is provided with bulkheads dividing the cable compartment into zones.

4. A device according to claim 1 or 2, wherein the cable compartment is provided with decks dividing the cable compartment into zones.

* * * * *